US005975890A

United States Patent [19]

Kawasaki et al.

[11] Patent Number: 5,975,890

[45] Date of Patent: Nov. 2, 1999

[54] CATALYTIC COMBUSTOR

[75] Inventors: Yoshitaka Kawasaki, Nabari; Jiro Suzuki, Nara; Masato Hosaka, Osaka; Akira Maenishi, Ikeda; Motohiro Suzuki, Moriguchi; Shigehiko Fujita, Hirakata, all of Japan

[73] Assignee: Matsushita Electric Industrial Co., Ltd., Osaka, Japan

[21] Appl. No.: 09/011,881

[22] PCT Filed: Jun. 12, 1997

[86] PCT No.: PCT/JP97/02039

§ 371 Date: Feb. 17, 1998

§ 102(e) Date: Feb. 17, 1998

[87] PCT Pub. No.: WO97/48945

PCT Pub. Date: Dec. 24, 1997

[30] Foreign Application Priority Data

Jun. 17, 1996 [JP] Japan ..... 8-155552
Sep. 11, 1996 [JP] Japan ..... 8-240051

[51] Int. Cl.[6] ..... F23D 14/12

[52] U.S. Cl. ..... 431/328; 126/92 AC; 126/92 B

[58] Field of Search ..... 431/328, 329; 126/92 R, 92 AC, 92 B, 92 C

[56] References Cited

U.S. PATENT DOCUMENTS 3,203,413 8/1965 Hartzell et al. ..... 126/92 B
4,413,612 11/1983 Nakamura et al. ..... 431/328
5,158,448 10/1992 Kawasaki et al. ..... 431/328
5,352,114 10/1994 Numoto et al. ..... 431/328

FOREIGN PATENT DOCUMENTS 62-148811 9/1987 Japan .
62-185317 11/1987 Japan .
63-207914 8/1988 Japan .
4-353306 12/1992 Japan .
5-340515 12/1993 Japan .

*Primary Examiner*—Carroll Dority
*Attorney, Agent, or Firm*—Ratner & Prestia

[57] ABSTRACT

A catalytic combustor utilizes radioactive heat with a high efficiency, has a radiation wavelength distribution rich in visible ray components, and is excellent in complete combustibility and visual confirmability even in a standby combustion condition. The present invention forms a thin film coat of metal or metal oxide which transmits rays having short wavelengths and reflects rays having long wavelengths on a surface of a transmission window disposed opposite to an upstream surface of a catalyst body. The catalyst body is composed of a metal wire structure having a high aperture ratio and is disposed in a combustion chamber. Furthermore, an auxiliary catalyst body which has a high aperture ratio and a small capacity is disposed in the vicinity of a mixed gas injection port at a location in contact with the mixed gas when the flow rate of the mixed gas is less than a predetermined value. Moreover, a freely openable/closable cover having reflectivity to heat rays is disposed in the vicinity of an outside surface of the transmission window. An air flow path is formed between the transmission window and a second transmission window. Also a thin film coat reflecting radioactive heat rays having long wavelengths is disposed on an inside surface of the second transmission window.

16 Claims, 12 Drawing Sheets

17 Concave mirror section

1 Fuel tank

2 Control valve

3 Mixer

4 Premixing chamber

5 Injection port

6 Catalyst body

7 Igniter

8 Exhaust gas flow path

9 Transmission window 12, 120 Metal catalyst bodies

40 Rectifier plate

41 Combustion chamber

13 Reflecting plate

14 Auxiliary catalyst body

15 Reflecting cover

16 Peep window

17 Concave mirror section

18 Second transmission window

19 Air flow path

CATALYTIC COMBUSTOR

This Application is a U.S. National Phase Application of PCT International Application PCT/JP97/02039.

TECHNICAL FIELD

The present invention relates to a catalytic combustor which effectively utilizes radioactive heat rays produced due to burning reaction heat, and more specifically effective utilization of the reaction heat and stabilization of combustion.

BACKGROUND ART

There have conventionally been proposed a large number of catalytic combustors which use catalysts having oxidative activities to fuels composed mainly of hydrocarbons and there is known a combustor which utilizes radioactive heat rays emitted from a surface of a catalyst directly or as radioactive heat supplied by way of a heat ray transmissive window.

In the conventional appliances described above, heat rays are radiated from a downstream surface of an exposed catalytic body to use the rays for heating, etc. in a type which supplies only a fuel through communicating slots of a catalyst body and allows catalytic oxidization to take place in the vicinity of the downstream surface of the catalytic body by diffusing and supplying oxygen in atmosphere, whereas heat rays are radiated from an upstream surface by way of a heat ray transmission window disposed in opposition to an upstream surface of a catalytic body to use the rays for heating, etc. in a type which allows a catalytic oxidative reaction to take place mainly in the vicinity of an upstream surface of the catalytic body by supplying a premixed gas of a fuel and air, and discharges an exhaust gas through communicating slots of the catalytic body.

The conventional catalytic combustors described above are useful for heating, but when they are used for illumination, they have defects as explained below.

That is, the catalytic combustors do not always provide high efficiencies when they are used for illumination in particular due to a fact that the heat rays which are obtained as radiation have a broad wavelength distribution ranging from the visible region (wavelengths not longer than 1 $\mu$m) to the far infrared region (wavelengths not shorter than 3 to 5 $\mu$m) which is variable dependently on surface temperatures of catalytic materials though they provide radiation efficiencies (ratios of obtained radioactive heat relative to reaction heat of fuels) higher than those of combustors which heat radiative materials with exhaust gases obtained by flame combustion due to a fact that the oxidative reaction of the fuels proceeds on surfaces of the catalyst bodies, the reaction heat is transferred directly to the catalyst bodies and radiated from the catalyst bodies with high efficiencies. Speaking concretely of a range within which the catalytic combustion is practically usable, an upper limit of a combustion rate of a catalyst body having a unit volume is restricted by a heat-resisting limit temperature of an active component (for example, a metal of a platinum group) carried on a catalyst layer and a lower limit of the combustion rate is restricted by a lower limit temperature at termination of a reaction due to a characteristic of the catalytic combustion that a temperature of the catalyst body is enhanced or lowered correspondingly to an amount of a fuel which reacts on a surface of the catalyst body. Though catalyst body is usable within a range from approximately 100° C. to approximately 900° C. in cases of fuel components such as hydrogen and carbon monoxide which are apt to be oxidized at low temperatures, lower limit temperatures of the catalyst body are 400° C. to 500° C. for propane, butane, kerosine which are ordinary domestic hydrocarbon fuels, and 650° C. to 700° C. for methane which is a main component of natural gases, whereas upper limit temperatures are on the order of 900° C. for all the fuels mentioned above, whereby radioactive heats (rays) emitted from the catalyst body have broad wavelength distributions each of which has a peak at 1 to 3 $\mu$m and includes components exceeding 10 $\mu$m. Accordingly, radiated-ray components are usable for illumination only at several percents or low efficiencies and almost all heats are output as unnecessary heat outputs.

Even when the conventional catalytic combustors are used for heating, on the other hand, they provide radiation efficiencies (ratios of radiated heats relative to reaction heats of fuels) which are higher than those obtained by heating heat radiative bodies with exhaust gas obtained from flame combustion but limited to approximately 40 to 50%. Further, an upper limit of a combustion density (a combustion rate per apparent unit area of a main combustion surface of a catalyst body) is determined by a heat-resisting temperature of a substrate composing a catalyst body or a carried active component, and when a noble metal of the platinum series is carried as an active component on a ceramic honeycomb substrate, for example, a service heat-resisting temperature is on the order of 850 to 900° C. and a combustion density is limited to approximately 10 to 15 kcal/h·cm$^2$ though variable dependently on dissipation ratios of radioactive heat. Accordingly, it is actually obliged to suppress a combustion rate so as to keep a combustion density below this level or enlarge an area of a catalyst body, whereby it is difficult to produce a large amount of radioactive heat with a combustion chamber having a small volume.

After all, the conventional catalytic combustors are insufficient in their performance for use as portable heaters and illuminators which are to be used outdoors and it is therefore demanded to develop a combustor which has a smaller combustion chamber and produces a larger amount of radioactive heat.

For setting a catalyst body in a high temperature incandescent condition at its steady combustion state, it is necessary to preliminarily heat it up or raise its temperature until it exhibits its reaction activity. When a combustor is used intermittently, it is obliged to perform preheating and ignition operation, and wait until the catalyst material reaches its active temperature (on the order of 300° C. to 500° C. different dependently on kinds of fuels and conditions of use) before each use, thereby causing extreme inconvenience in practical use. Therefore, the combustor is practically operated so as to maintain the so-called standby combustion condition where a burning reaction is continued by feeding a fuel or a mixed gas at a low rate for keeping the catalyst body at a temperature in the vicinity of a minimum temperature at which the active temperature can be maintained and enhance the feeding rate of the fuel for obtaining required heat and rays in a moment for practical use of the combustor. In this standby combustion condition, however, the catalyst body is kept at a temperature lower than a region within which it is incandescent (emits visible rays),and the continuation of the combustion cannot be visually recognized, whereby even presence of the combustor which is used for illumination in a dark environment cannot be confirmed. In addition, a fair amount of combustion heat is necessary for keeping the catalyst body at the temperature in the standby combustion condition and a fuel consumption in the standby combustion condition constitutes a heavy burden on a combustor equipped with a cartridge type fuel container for outdoor use, thereby posing problems that it shortens usable time and that it requires an extraordinarily large fuel container.

DISCLOSURE OF THE INVENTION

The present invention has a primary object to solve the problems posed by the conventional catalytic combustor.

For solving the problems described above, the catalytic combustor according to the present invention is characterized in that it is configured so as to comprise a heat ray transmission window which is disposed in a wall of a premixing chamber at a location opposed to an upstream surface of a catalyst body, and a thin film coat made of a metal or a metal oxide which transmits visible rays and reflects infrared rays is disposed on a surface of this transmission window. Further, a flow rate control valve made of a heat-sensitive deformable metal (a bimetal or a form storing alloy) is disposed in a premixed gas introducing port of the premixing chamber for controlling an aperture of a flow path in correspondence to temperatures of the catalyst body. Furthermore, transmission windows are disposed in two layers, the thin film coat is disposed only on an outside surface of an outer transmission window on an outer layer, and the transmission window on the outer layer is freely attachable and detachable.

Further, the catalytic combustor according to the present invention is characterized in that it comprises a catalyst body which has a large number of communicating slots and is disposed in the vicinity of a downstream end of a combustion chamber equipped on a side wall thereof with a transmission window made of a heat ray transmissive material, and a metal catalyst body which has a downstream end in the vicinity of the catalyst body and an upstream end directed toward a premixed gas injection port, and is disposed nearly in parallel with the transmission window and composed of an oxidative catalyst component carried on a metal wire structure such as a metal mesh or an expanded metal having a high aperture ratio. This metal catalyst body is composed of a multiple layers of cylindrical or planar layers which have different length in a flow direction of the premixed gas, and are arranged so as to form gaps therebetween and not to align their tips. Furthermore, the metal catalyst body is configured so as to have a conical or pyramidal form which has a tip on the upstream side and a bottom in the vicinity of the catalyst body. In addition, the transmission window is disposed along almost all circumference of the combustion chamber and a heat ray reflecting body is disposed in the vicinity of at least a portion of an outside surface of the transmission window.

Moreover, the catalytic combustor according to the present invention is characterized in that it comprises, in the vicinity of a mixed gas injection port disposed between a catalyst body having a large number of communicating slots and a heat rays transmission window disposed in opposition to an entire surface of the catalyst body, an auxiliary catalyst material which has a high aperture ratio and a small volume, and is disposed at a location brought into contact with stream lines when an amount of the mixed gas is not larger than a definite or predetermined value. The catalytic combustor comprises a freely openable/closable cover which is interlocked with mixed gas flow rate control means so as to cover an outside surface of the transmission window when the mixed gas flow rate is lower than a definite level. Furthermore, transmission windows are formed in two layers, a thin film coat which reflects radioactive heat having long wavelengths is disposed on an inside surface of an outer transmission window and an atmosphere flow path is formed between the two transmission windows.

Figure 8:
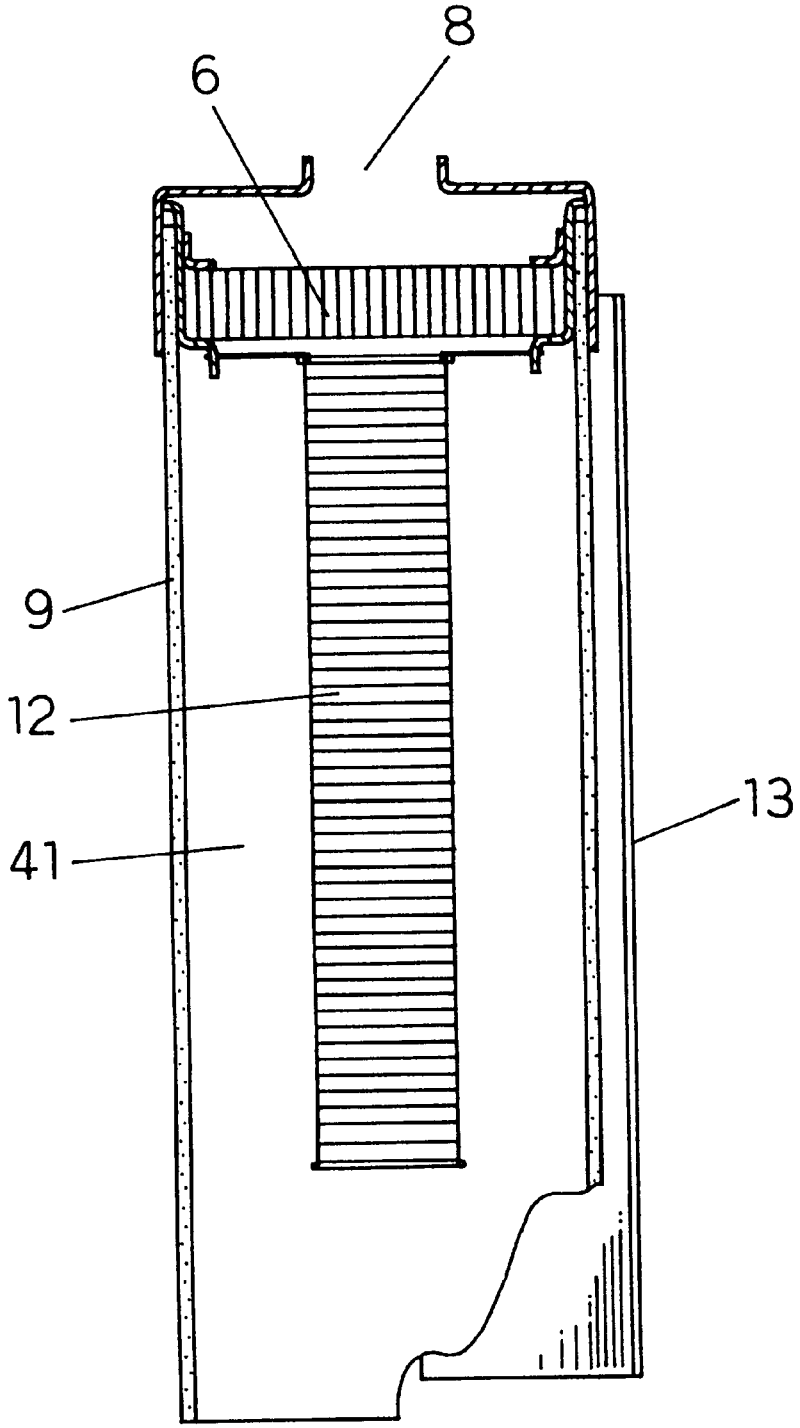
FIG. 8 is a schematic sectional view showing main parts of a sixth embodiment of the present invention.
Figure 10:
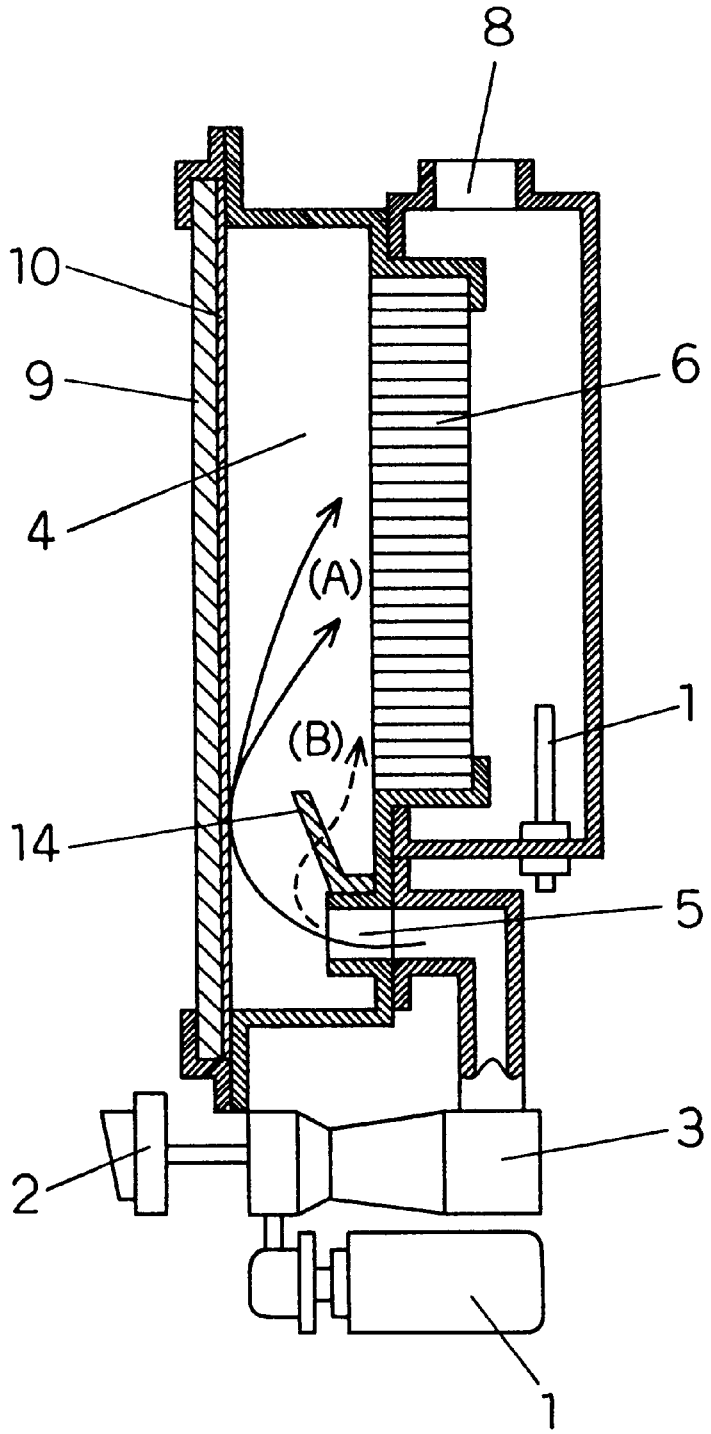
Figure 11:
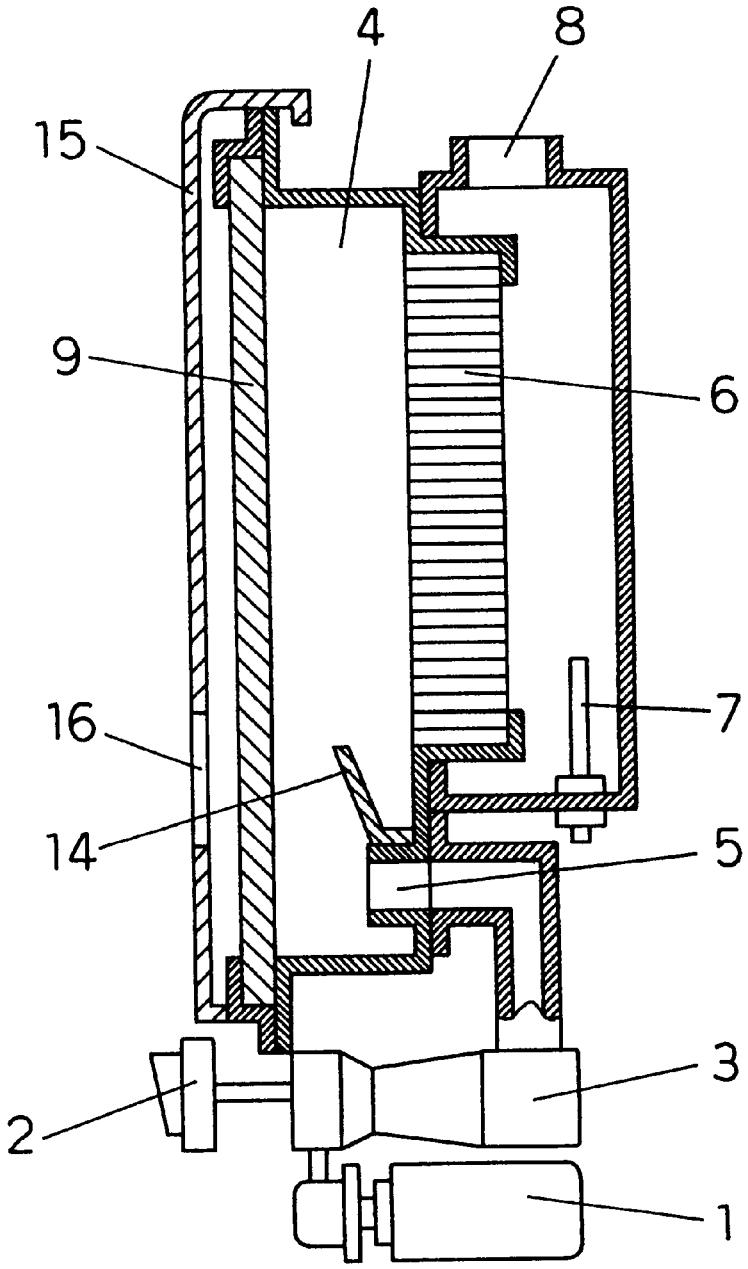
Figure 12:
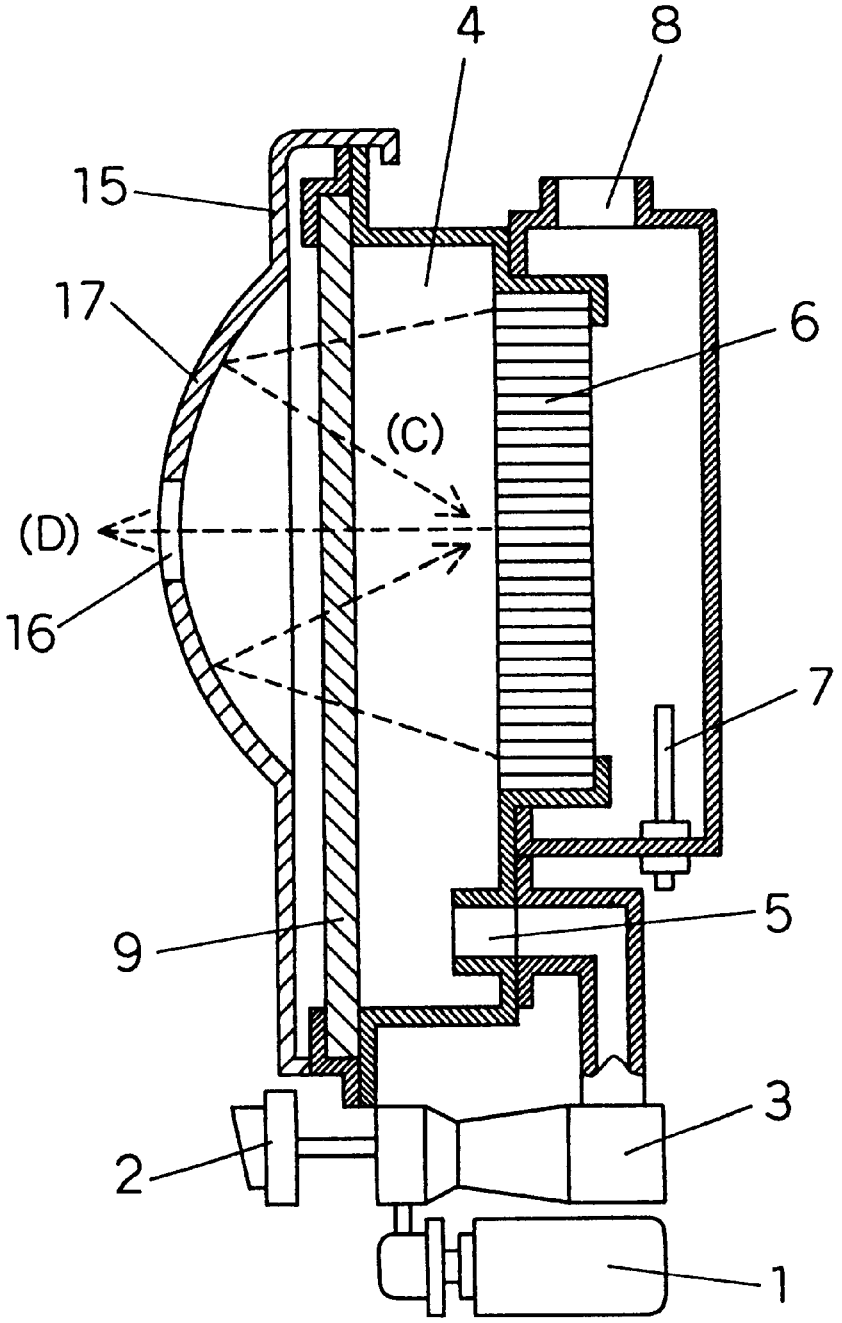
Figure 13:
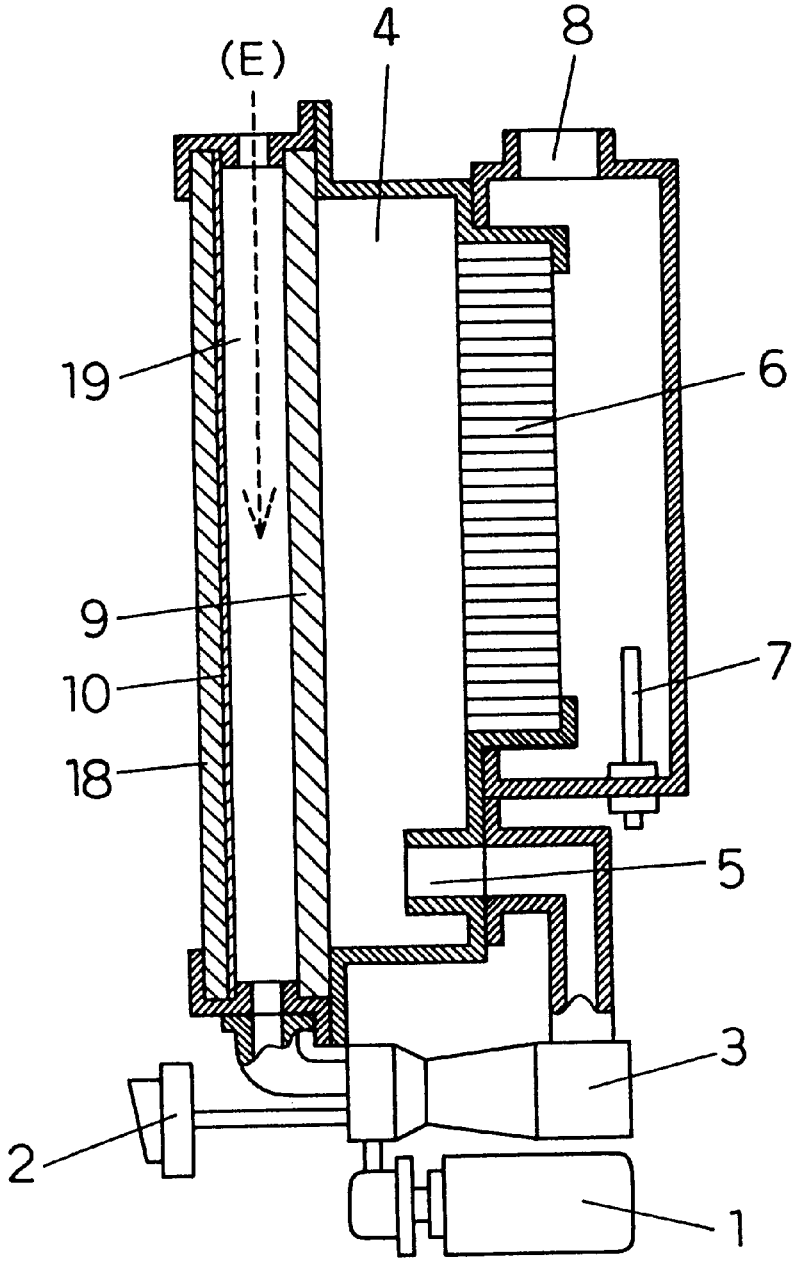

FIG, 9 is a horizontal sectional view illustrating main parts of the combustor shown in FIG. 8;

FIG. 10 is a sectional view illustrating a configuration of a seventh embodiment of the present invention;

FIG. 11 is a sectional view illustrating a configuration of an eighth embodiment of the present invention;

FIG. 12 is a sectional view illustrating a configuration of a ninth embodiment of the present invention; and FIG. 13 is a sectional view illustrating a configuration of a tenth embodiment of the present invention.

(Description of Reference Numerals)

1. Fuel tank
2. Control valve
3. Mixer
4. Premixing chamber
40. Rectifier plate
41. Combustion chamber
5. Injection port
6. Catalyst body
7. Igniter
8. Exhaust gas flow path
9. Transmission window
90. Movable window
10. Coat layer
11. Flow rate control valve
12, 120 Metal catalyst bodies
13. Reflecting plate
14. Auxiliary catalyst body
15. Reflecting cover
16. Peep window
17. Concave mirror section
18. Second transmission window
19. Air flow path Best Embodiments Now, embodiments of the present invention will be described with reference to the accompanying drawings. For embodying the present invention, an igniter, a flow rate controller, a fuel-air mixer are required in addition to a catalyst body which has a large number of communicating slots and an oxidative activity to various kinds of hydrocarbons, a heat ray transmissive material which has heat resistance, a material which reflects heat rays and a metal catalyst body etc., and a carbureter for liquid fuels, temperature detector, a driving gear and so on are necessary as occasion demands. Used as the catalyst body is an active component mainly composed of a noble metal such as platinum or palladium carried on a metal or ceramic honeycomb carrier, a carrier of braided ceramic fibers, a porous sintered material or the like, whereas quartz glass or crystallized glass is used as the heat ray transmissive material having heat resistance. Used as the metal catalyst body having a high aperture ratio is a noble metal of the platinum group carried on a mesh made of a heat resistant metal of an iron-chromium-aluminium series or an expand metal and employed as the material which reflects infrared rays is a deposited thin film of a metal oxide or a metal such as tin oxide, ITO (a composite oxide of indium-tin), aluminium or copper. Further, a manual needle valve, an electric solenoid valve, etc. are used for controlling flow rates of air and gas fuels, whereas an electromagnetic pump, etc. are used for liquid fuels. Other driving members can be operated with manual levers or an automatically controlled motor and an electric heater or a discharge igniter is usable as the igniter. These are means which are conventionally adopted widely and may be replaced with other known means. These means are not described in details herein.

(First Embodiment)

Figure 1:
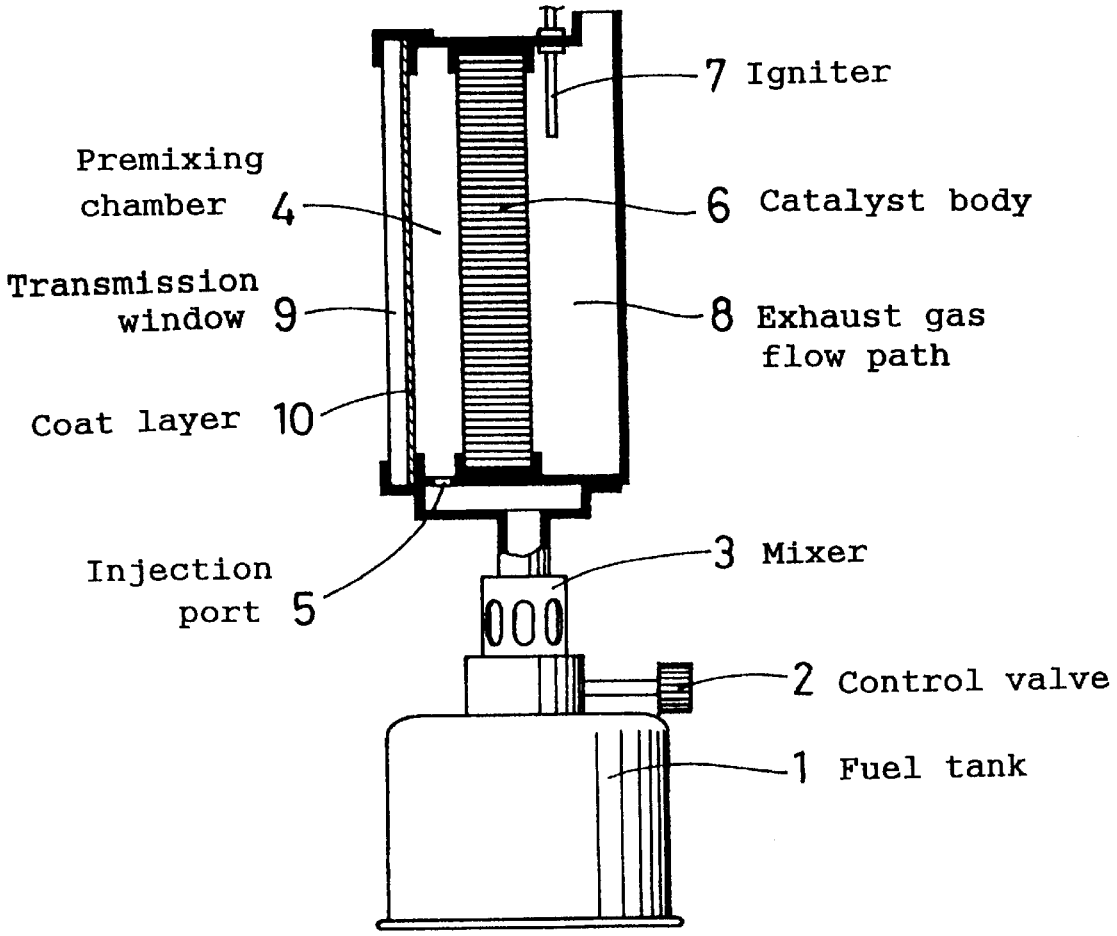
FIG. 1 is a sectional view partially illustrating a first embodiment of the present invention.
Figure 2:
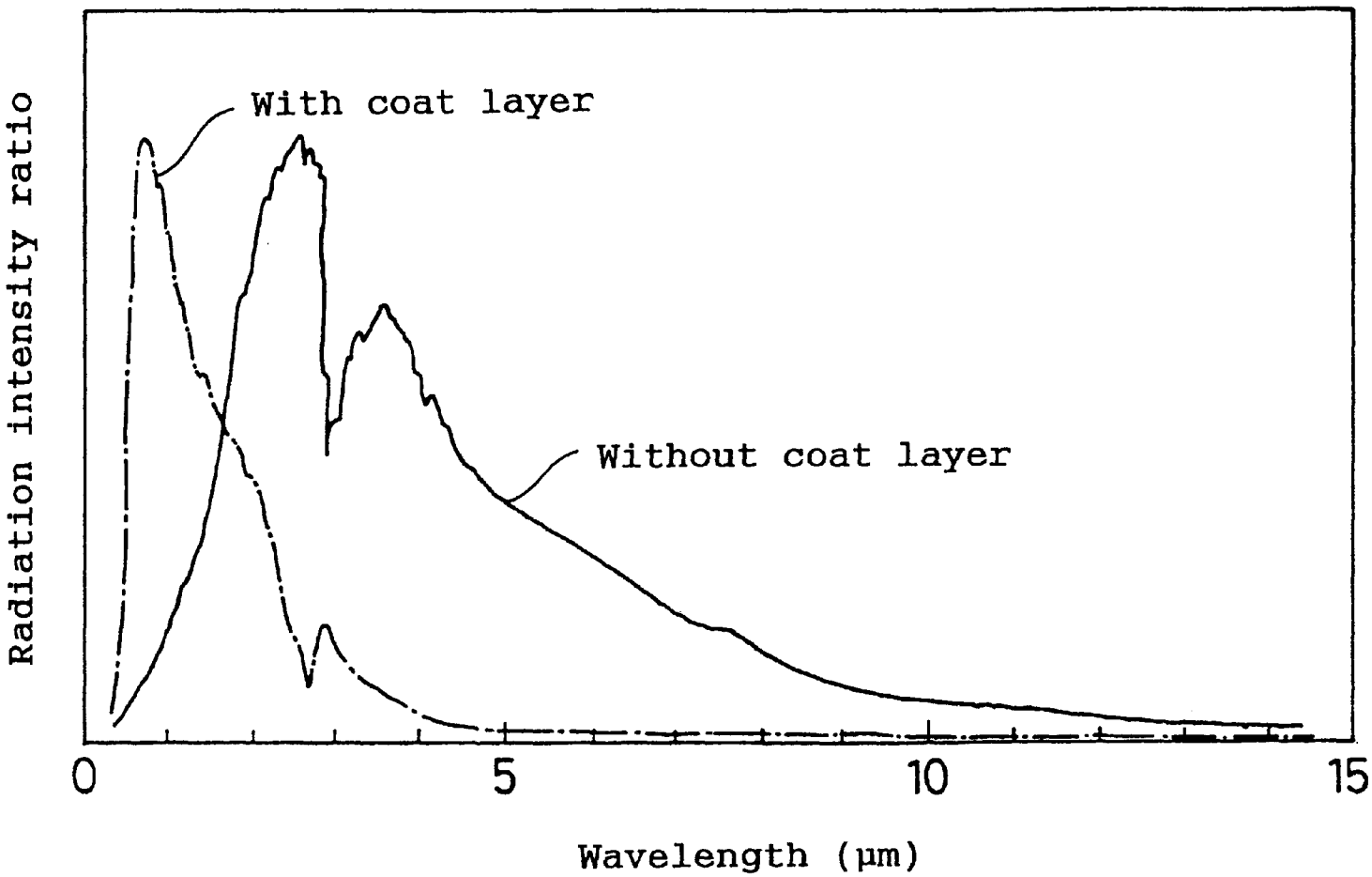
FIG. 2 is a graph illustrating a heat radiation characteristic of the combustor shown in FIG. 1.

FIG. 1 is a partial sectional view illustrating the first embodiment of the catalytic combustor according to the present invention and FIG. 2 is a graph illustrating its radiation characteristic. In FIG. 1, a reference numeral 1 represents a fuel tank, a reference numeral 2 designates a control valve which controls an injection rate of a fuel, a reference numeral 3 denotes a mixer and a reference numeral 4 is a premixing chamber which is communicated with the mixer 3 through an injection port 5. A reference numeral 6 represents a catalyst body which is composed of a noble metal of the platinum group carried on a ceramic honeycomb, a reference numeral 7 designates an igniter which is composed of an electric heater and a reference numeral 8 denotes an exhaust gas flow path. A reference numeral 9 is a transmission window which is made of a crystallized glass material and disposed at a location opposed to the catalyst body 6. A thin film coat layer 10 which is formed by depositing ITO (a composite oxide of In and Sn) is disposed on an inside surface of the transmission window 9.

Now, description will be made of operations and a characteristic of the first embodiment. Upon releasing the control valve 2, a fuel (butane gas in the first embodiment) contained in the fuel tank 1 is discharged under a high pressure, mixed in the mixer 3 which is internally equipped with a nozzle and a slot (not shown) while sucking ambient air with a gas flow injected from the nozzle, and supplied into the premixing chamber 4 through the injection port 5. At an initial combustion stage, a premixed gas which has reached the exhaust gas flow path 8 through the communicating slots of the catalyst body 6 is ignited by supplying electric power to the igniter 7 for starting flame combustion on a downstream side of the catalyst body 6 (i.e., on a side of the exhaust gas flow path 8). The catalyst body 6 which is heated by the flame starts catalytic combustion in the vicinity of a downstream side surface thereof which is first heated, an upstream side is repeatedly heated by combustion heat and the catalytic combustion shifts to the vicinity of an upstream surface (i.e., a surface opposed to the premixing chamber 4), whereby the catalyst body is set in a steady state combustion condition. The upstream side surface of the catalyst body 6 reaches 600 to 700° C. (different dependently on a feeding rate of the premixed gas) and starts slight incandescence. Heat rays are radiated from the surface of the catalyst material 6 toward the transmission window 9. Though an ordinary crystallized glass material allows almost all the radiated heat rays having wavelengths not exceeding 5 $\mu$m to transmit there through and be supplied forward, the coat layer 10 composed of the thin film of ITO reflects components having wavelengths longer than approximately 2 $\mu$m and allows these components to be absorbed again by the catalyst body 6, thereby enhancing its temperature though components having wavelengths shorter than approximately 2 $\mu$m transmit through the coat layer 10. Accordingly, a temperature of the catalyst body 6 is further enhanced and it is set in an incandescent condition having high luminance, thereby increasing a radiation rate of the components having the short wavelengths. It is possible to emit a large amount of radiative rays at a low fuel feeding rate by repeating the recovery of the heat ray components having the long wavelength, temperature enhancement and re-radiation, accelerate completion of the reaction by maintaining the catalyst body 6 at a high temperature and secure complete combustion without exhausting unburnt components into the exhaust gas flow path 8 even when the catalytic combustor uses a fuel component such as methane which will react extremely difficulty.

Description will be made of characteristics at the combustion stage explained above with reference to FIG. 2. When the coat layer 10 is not disposed on the transmission window 9 (indicated by a solid line in FIG. 2), radiation intensity is attenuated in the vicinity of 3 $\mu$m and within a range not shorter than 5 $\mu$m under an influence due to transmittance of the crystallized glass material which composes the transmission window 9, but heat rays absorbed by the transmission window 9 raise a temperature of the transmission window 9 itself, from which heat is supplied again as a secondary radiation, whereby a broad wavelength distribution which has high radiation intensities even within a long wavelength region is obtained as a composite of both the primary and secondary radiation. When the coat layer 10 is disposed (indicated by a chain line in FIG. 2), in contrast, the combustor exhibits a radiation characteristic which restricts most of heat rays within a region shorter than 2 $\mu$m and has a high peak within the visible region in particular (wavelengths shorter than 1 $\mu$m) though the transmission window emits a slight secondary radiation. Accordingly, it is possible to obtain an illumination light beam with a high efficiency by eliminating components having long wavelengths which do not contribute to illumination, and utilize the eliminated (reflected) components for raising the temperature and convert them again into the components having the short wavelengths. Moreover, the function makes it possible to provide a combustion illuminator having remarkably high economical effect since this function allows to maintain a high reaction temperature even when a fuel is supplied at a low rate and secure complete combustion even when a sparingly combustible fuel (methane gas or a dilute mixture gas) is used.

Though the coat layer 10 is disposed on the inside surface of the transmission window 9 in this embodiment, it may be preferable, in a certain case or dependently on materials of the coat layer 10, to dispose it on an outside surface since the coat layer 10 disposed on the outside surface provides a similar effect and is subjected to less thermal deterioration. When the coat layer 10 is disposed on the inside surface, however, the transmission window 9 is heated by radioactive heat from the catalyst body 9 (due to the absorption of heat rays) and suppresses the loss to be caused due to increase in the secondary radiation from the transmission window 9, thereby securing a higher energy efficiency. Further, it is possible to select, as a material for the coat layer 10, a thin film of any metal or metal oxide so far as it transmits the visible rays, for example, a metal such as gold or a metal oxide such as tin oxide, titanium oxide or indium oxide, and it is possible to add a wavelength converting material such as Eu or YV4 to the coat layer 10 for converting the radioactive rays from the components having the long wavelengths to the components having the short wavelengths without affecting the effect described above.

(Second Embodiment)

A second embodiment of the present invention will be described. The second embodiment is configured so as to open and close a flow path in correspondence to surface temperatures of a catalyst body 6 by disposing a flow rate control valve made of a heat sensitive deformable metal in an injection port 5 which is formed as a premixed gas inlet into a premixing chamber 4 and has a fundamental function which is similar to the first embodiment, but is different in that the second embodiment is configured to control a premixed gas feeding rate by itself. Accordingly, description will be made mainly of the different point.

Figure 3:
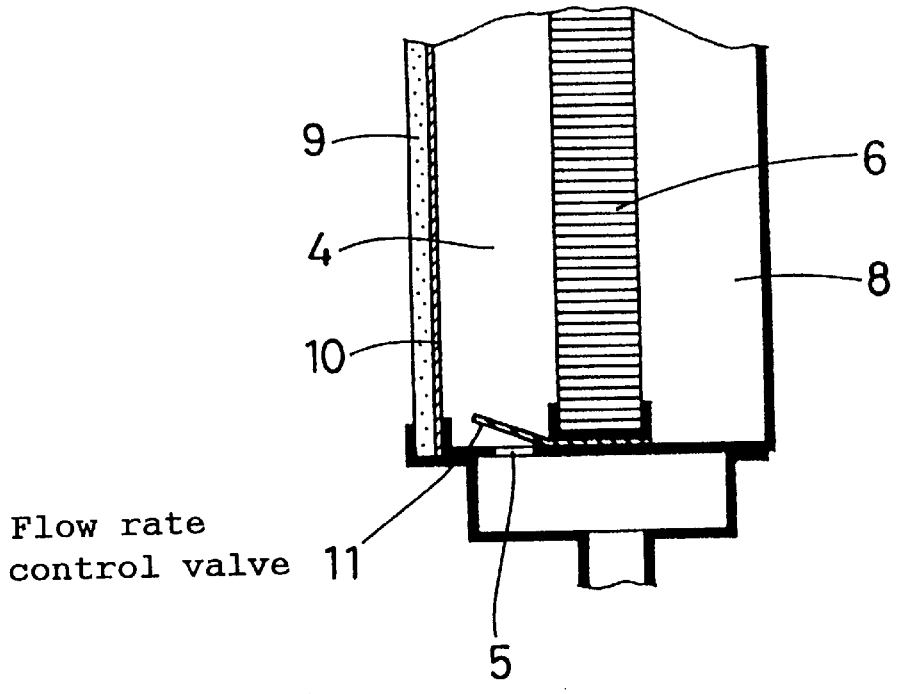
FIG. 3 is a schematic sectional view showing main parts of a second embodiment of the present invention.

FIG. 3 is a schematic sectional view showing main parts of the second embodiment. In FIG. 3, a lid-like flow control valve 11 composed of a bimetal which is curved or deformed by variations of its own temperature is disposed upstream an injection port 5 for introducing a premixed gas into a premixing chamber 4. This flow control valve is configured to be curved or deformed in a direction to close the injection port 5 when a temperature of the catalyst body 6 is raised or in a direction to open the injection port 5 when the temperature of the catalyst body 6 is lowered, thereby automatically controlling a flow rate of the premixed gas which passes through the injection port 5. Accordingly, the flow control valve 11 is capable of preventing the catalyst body 6 from being overheated and thermally deteriorated by narrowing an aperture area of the injection port 5 and limiting a feeding rate of the premixed gas when the heat rays having the long wavelengths reflected by a coat layer 10 abnormally raise a temperature of the catalyst body 6. In a condition where complete combustion cannot be maintained due to a lowered temperature of the catalyst body 6, on the other hand, the flow control valve 11 is curved in a reverse direction to increase the area of the injection port 5, thereby functioning to raise a temperature of the catalyst body 6 and maintain it at a high level. Accordingly, the second embodiment is capable of preventing the catalyst body 6 from being thermally injured and exhibiting stable performance for a long time while maintaining sufficient radiative rays and reactivity without controlling the control valve 2 each time. The second embodiment is therefore excellent in its illumination characteristic.

Though it is preferable to compose the flow control valve 11 used in the second embodiment of a bimetal which is continuously deformed following temperatures, it is possible to compose the flow control valve 11 of a form storing alloy which repeats a discontinuous ON/OFF control dependently on purposes of use. When the catalyst body 6 is composed of a ceramic honeycomb or a ceramic sintered material which has a large thermal capacity in particular, the latter material is sufficiently usable since it is capable of preventing incomplete combustion from being caused due to abrupt temperature drop by the ON/OFF control.

(Third Embodiment)

A third embodiment of the present invention will be described below. The third embodiment has a configuration which is fundamentally the same as that of the first embodiment, but is different in that transmission windows are formed in two layers. Description will be made mainly of this difference.

Figure 4:
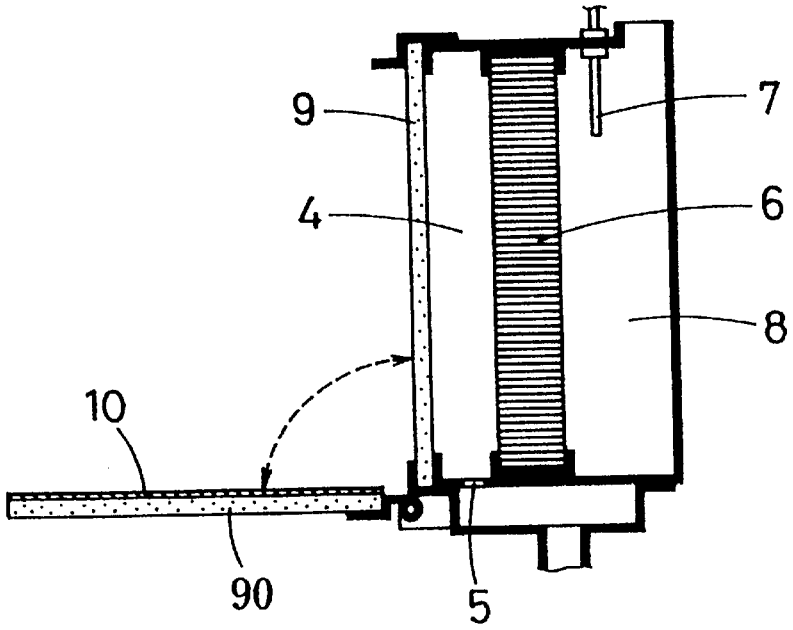
FIG. 4 is a schematic sectional view showing main parts of a third embodiment of the present invention.

FIG. 4 is a schematic sectional view showing main parts of the third embodiment. In FIG. 4, a transmission window 9 which is fixed in opposition to an upstream surface of a catalyst body 6 and a movable window 90 which is disposed so as to be freely opened and closed are formed in two layers, and a coat layer 10 made of a thin ITO film is deposited on an inside surface of the movable window 90. When the movable window 90 is fallen down to open an entire surface, an upstream incandescent surface of the catalyst body 6 is covered only with the transmission window 9 and radioactive heat rays are supplied over the entire wavelength region as indicated by the solid line in FIG. 2. When the movable window 90 is erected and kept in contact with the transmission window 9, on the other hand, the coat layer 10 reflects and eliminates the heat rays which have long wavelengths, thereby changing the third embodiment into a combustor which emits radioactive rays having short wavelengths or consisting mostly of visible rays. Accordingly, the third embodiment is extremely effective and convenient to use, for example, for outdoor works and amusements since it is switchable promptly and easily by opening the movable window 90 when the catalytic combustor is to be used for heating and closing the movable window 90 when the combustor is to be used for illumination.

(Fourth Embodiment)

Description will be made of a fourth embodiment of the present invention. The fourth embodiment is similar in a fundamental configuration to the first embodiment, but is different in that it uses a metal catalyst body having a large aperture ratio which is disposed upstream a catalyst body 6. Description will be made mainly of this difference.

Figure 5:
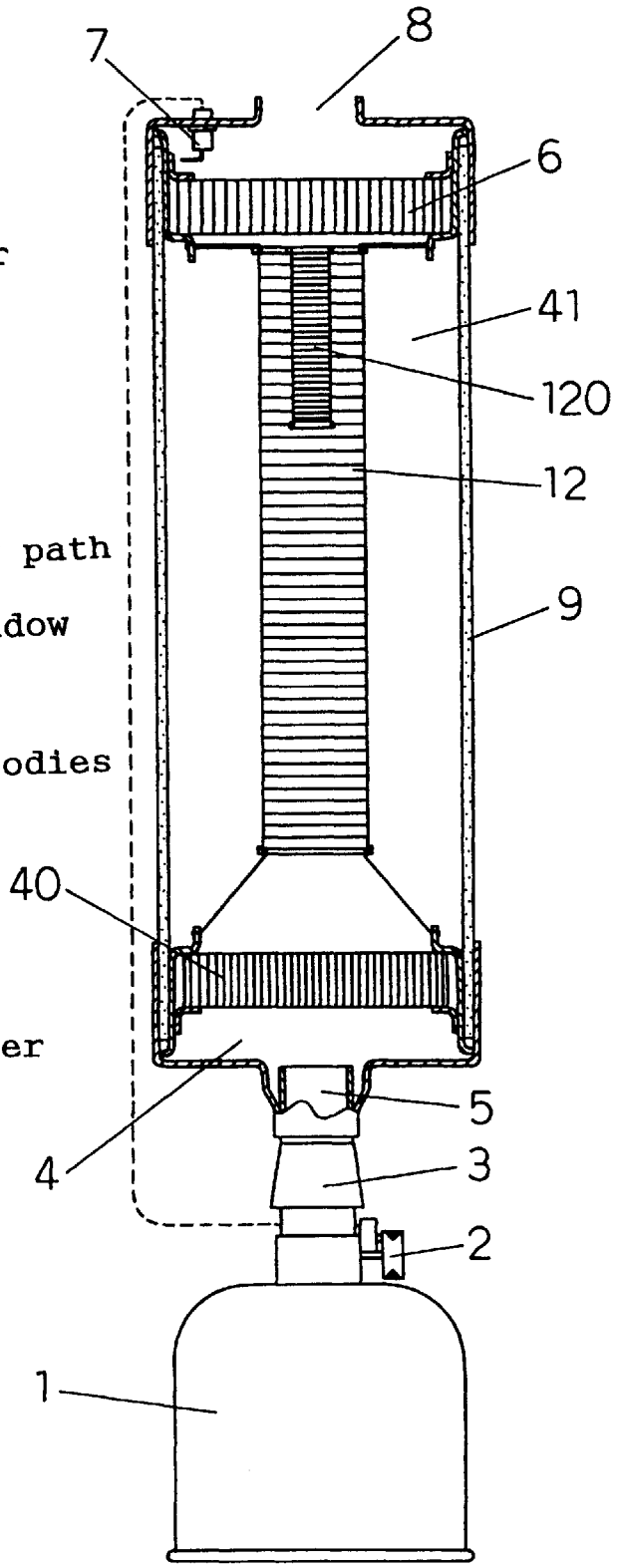
FIG. 5 is a sectional view illustrating a fourth embodiment as a whole of the present invention.
Figure 6:
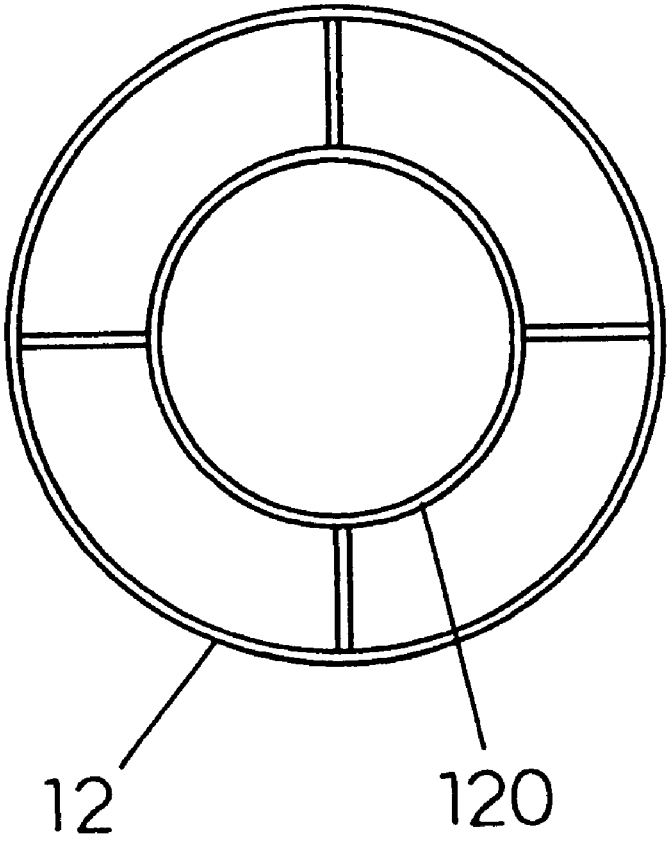
FIG. 6 is a horizontal sectional view illustrating main parts of the combustor shown in FIG. 5.

FIG. 5 is a sectional view showing the fourth embodiment as a whole and FIG. 6 is a horizontal sectional view showing main parts of the fourth embodiment. In FIG. 5, a combustion chamber 41 is composed between an injection port 5 which communicates with a premixing chamber 4 and an exhaust gas flow path 8, a rectifier plate 40 which horizontally disperses a premixed gas injected from the injection port 5 is disposed upstream the combustion chamber 41 and a catalyst body 6 which is composed of a noble metal of the platinum group carried on a ceramic honeycomb is disposed in the vicinity of the exhaust gas flow path 8. A reference numeral 9 represents a transmission window which is made of a heat resistant glass material and constitutes a circumferential wall surface of the combustion chamber 41 located upstream. Further, reference numerals 12 and 120 designate metal catalyst bodies each of which has an end located in the vicinity of an upstream surface of the catalyst body 6 and the other end extending toward the injection port 5, and is composed of a noble metal of the platinum group carried on a surface of an expanded metal. The outer metal catalyst body 12 is configured long, the inner metal catalyst body 120 is configured short and these metal catalyst bodies are arranged so that their tips (i.e., the ends on the side of the injection port 5) are not overlapped with each other. The metal catalyst bodies 12 and 120 are disposed concentrically with gaps reserved therebetween as shown in FIG. 6. Furthermore, such thin films as those described above may be formed on an inside surface and an outside surface of the transmission window 9, etc. in FIG. 5.

Now, operations of the fourth embodiment will be described below. A fuel gas (an LPG having a main component of butane in the fourth embodiment) which is supplied from a fuel tank 1 is mixed with air in a mixer 3 after its flow rate is adjusted by a control valve 2 and flows into the injection port 5. A premixed gas which is injected from the injection port 5 through a premixing chamber 4 into the combustion chamber 41 is dispersed adequately in a radial direction by the rectifier plate 40, flows toward the catalyst body 6 which has a honeycomb structure and further flows to a downstream surface of the catalyst body 6 through its communicating slots. Upon igniting the premixed gas by supplying electric power to an igniter 7 at this stage, flame combustion starts in the vicinity of the downstream surface of the catalyst body 6. The catalyst body 6 is heated by the flame and starts catalytic combustion first in the vicinity of its downstream surface whose temperature is raised first, its upstream side is heated repeatedly by combustion heat and the catalytic combustion shifts to an upstream surface of the catalyst body 6 or in the vicinity of the surface facing the combustion chamber 41, whereby the catalyst body 6 is set in a steady state combustion condition. In this condition, the upstream side surface of the catalyst body 6 reaches 700 to 900° C. (different dependently on amounts of the supplied premixed gas). Out of heat rays radiated from the upstream side surface, heat rays having short wavelengths are emitted directly through the transmission window 9 downward to surroundings, whereas heat rays having long wavelengths are once absorbed by the transmission window 9 and then emitted downward to the surroundings as a secondary radiation. Simultaneously, the hear rays are supplied also to the metal catalyst bodies 12 and 120 which are disposed in the vicinities of the upstream surface of the catalyst body 6 and absorbed by these catalyst bodies. Since the metal catalyst bodies 12 and 120 have substrates made of metal wires which have large aperture ratios and small thermal capacities, these bodies are easily heated by the heat rays radiated from the catalyst body 6 and start catalytic reactions at locations in the vicinities of the metal catalyst body 6. The reaction heat and radioactive heat from the metal catalyst body 6 soon function to heat also a location a little upstream the position of the burning reaction owing to the favorable heat conductivity of the metal wires composing the substrates of the metal catalyst bodies 12 and 120, and the heating is repeated sequentially, whereby the reaction takes place even at tips of the metal catalyst bodies and they are set in incandescent conditions. Since the metal catalyst bodies 12 and 120 have mesh-like structures which have the large aperture ratios, the premixed gas flowing around the metal catalyst bodies reaches downstream before all an amount of the premixed gas is reacted and is captured by the catalyst body 6 having the high density slots to complete the combustion.

When the metal catalyst bodies 12 and 120 are disposed in parallel with the flow direction of the premixed gas, they exhibit a characteristic that their upstream portions having many occasions to be brought into contact with the fuel which has not reacted and are incandescent with high luminance, whereas their downstream portions for which the fuel remains in a small amount are incandescent with low luminance. Though it is possible to set almost all the region of the transmission window 9 in an incandescent condition even by disposing the metal catalyst body 12 alone which has an adequate sectional shape and an adequate length, it is effective to dispose metal catalyst bodies 12, 120, . . . in multiple layers in a direction perpendicular to the flow direction of the premixed gas for causing a maximum reaction on the metal catalyst body 12 while reserving components which are not reacted on the metal catalyst body 6. In this case, locations of the metal catalyst bodies 12, 120, . . . are nearly defined since their downstream ends must be located in the vicinities of the metal catalyst body 6 for receiving heat from the metal catalyst body 6. On the other hand, it is preferable not to align the tips which are set in the incandescent conditions with the high luminance (set upstream) also for dispersing the heat radiation from the transmission window 9, or it is effective to adopt a dispersed multi-step (multi-layer) structure for setting the entire region of the transmission window 9 (in the flow direction) in the incandescent condition, and from viewpoints of visual effect and radiation efficiency. Such a structure makes it possible to accelerate production of radioactive heat by fully utilizing a space of the combustion chamber 41 without locally concentrating the combustion and obtain a radiation efficiency (a ratio of produced radioactive heat relative to combustion heat) of 60 to 70% which is far higher than those conventionally available. The metal catalyst materials 12, 120, . . . may be disposed so as to compose a multi-cylindrical structure as in the fourth embodiment, which is modifiable so that the metal catalyst bodies are sequentially shorter inward or outward. Further, the metal catalyst bodies can be composed by disposing simple metal meshes or planar plates such as expanded metals or punching metals so as to form multiple layers, or have no peculiar shape. However, the cylindrical forms which are hardly deformable by heat are most stable and exhibit an effect to make the metal catalyst bodies durable of use for a long time. Furthermore, the substrates of the metal catalyst bodies may be composed of punching metals or braided materials of metal fibers which have large aperture rations, or the effects of the present invention can be obtained so far as the metal catalyst bodies are composed of a material which has a small thermal capacity and a large aperture ratio.

Though the igniter 7 is disposed in the vicinity of the downstream surface of the catalyst body 6 for starting the combustion from the flame combustion on the downstream surface in the fourth embodiment, this configuration is not limitative so far as means for raising a temperature of the catalyst body 6 is available. It is possible, for example, to dispose igniter means in the vicinity of the injection port 5 for forming a flame first at this location and detect a temperature of the catalyst material 6 exceeding a predetermined temperature with temperature detector means or extinguish a flame once at a point of time at which the catalyst body 6 is heated up with an operation of a timer which operates continuously for a time sufficient for heating up the catalyst body 6 and start a catalytic combustion reaction by restarting fuel feeding. Alternately, it is possible to adopt a method to raise temperature of the catalyst body 6 to a predetermined temperature by electric heating with electric heating means disposed in the vicinity of the catalyst body 6. Any of these means does not lower the radiation characteristic described above. However, it is effective for practical use to adopt means which forms a flame on the downstream surface of the catalyst body 6 and shifts it to stable catalytic combustion since it does not require any complicated operation, detection, auxiliary part or a large amount of electric input.

(Fifth Embodiment)

A fifth embodiment of the present invention will be described. In the fifth embodiment, a metal catalyst body 12 which is to be disposed in a combustion chamber 41 is configured in a conical or pyramidal form whose tip is directed upstream. In other configurational respects and fundamental performance, the fifth embodiment is similar to the fourth embodiment, but is different in that surfaces of the metal catalyst body 12 are configured so as to be continuously slanted relative to a flow of a premixed gas. Therefore, description will be made mainly of the difference of the fifth embodiment.

Figure 7:
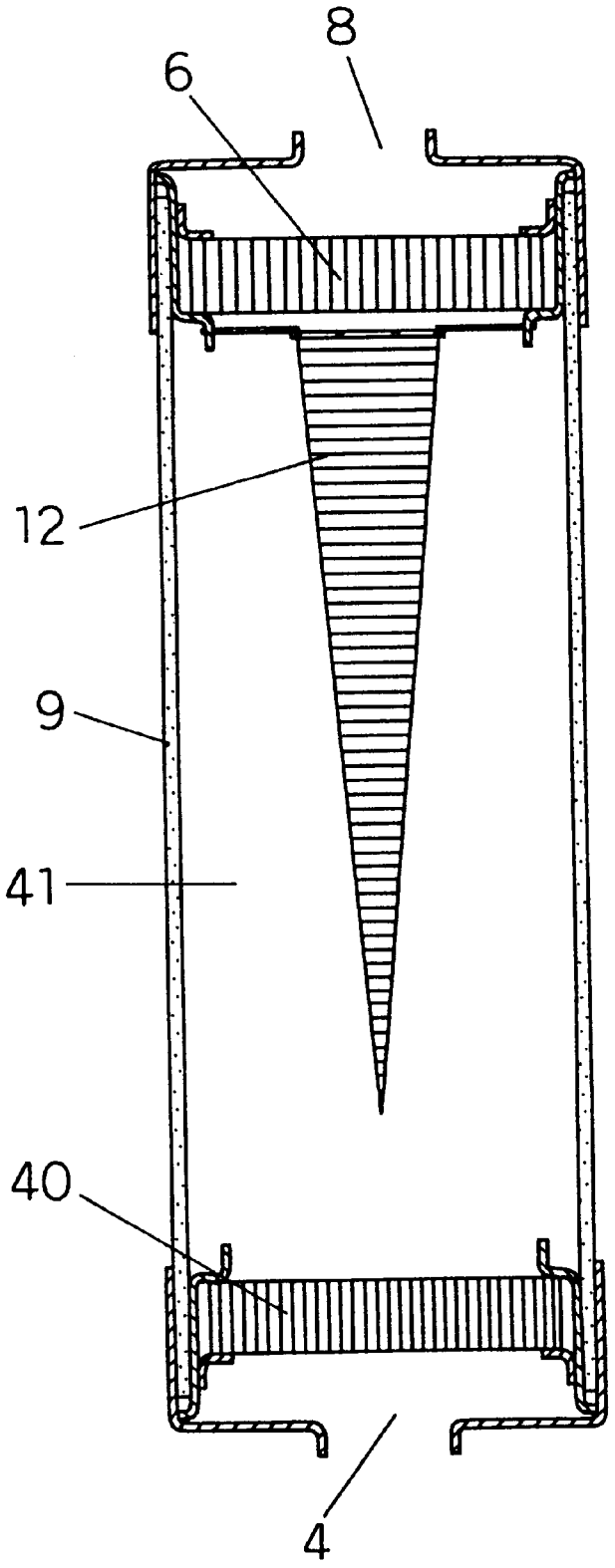
FIG. 7 is a schematic sectional view showing main parts of a fifth embodiment of the present invention.

FIG. 7 is a schematic sectional view showing main parts of the fifth embodiment. In FIG. 7, the metal catalyst body 12 is disposed so that its bottom is located in the vicinity of an upstream surface of the catalyst body 6 and its tip is directed upstream, whereby a wall surface of the metal catalyst body 12 is disposed obliquely relative to a flow line of a premixed gas which flows nearly upright by way of a rectifier plate 40. Accordingly, the premixed gas comes into contact with a tip portion of the metal catalyst body 12 in a central section of the combustion chamber 41 and the vicinities of the bottom of the metal catalyst body 12 disposed above in a marginal section of the combustion chamber 41, and reacts with a portion of a fuel in each of these sections, whereby the metal catalyst body 12 is incandesced over an entire region thereof with high luminance and radioactive heat is produced at a higher ratio. Further, the fifth embodiment is preferable from viewpoints of performance and a manufacturing cost since the metal catalyst body 12 eliminates a necessity to dispose a plurality of metal catalyst bodies and maintain positional relationship of the metal catalyst bodies, and can have a structure which is highly resistant to thermal deformation. Since the metal catalyst body 12 is composed of a material which has a high aperture ratio needless to say, all amount of the fuel passing through the metal catalyst body 12 does not react, and a fair amount of the fuel passes while remaining unreacted and is completely reacted on a catalyst body 6 of a ceramic honeycomb which is disposed downstream. A diameter and a height of the metal catalyst body 12 are variable dependently on specifications for materials which are to be selected therefor (thickness of a strand, roughness, shapes and directional properties of a mesh, etc.) and can be optionally determined taking into consideration balance between amounts of the fuel to be reacted on the metal catalyst body 12 and the catalyst body 6. Further, the conical form of the metal catalyst body 12 adopted for the fifth embodiment is not limitative and it is possible to configure the metal catalyst body 12 so as to have a form of a polygonal pyramid or a tetragonal pyramid without degrading the effect of the present invention. In addition, it is possible to form thin films such as those described above on an inside surface and an outside surface of the transmission window 9 shown in FIG. 7.

(Sixth Embodiment)

A sixth embodiment of the present invention will be described. The sixth embodiment has a fundamental configuration which is similar to that of the fifth embodiment, but is different in that it comprises a reflecting plate which is disposed outside a transmission window 9. Description will be made mainly of this difference.

Figure 9:
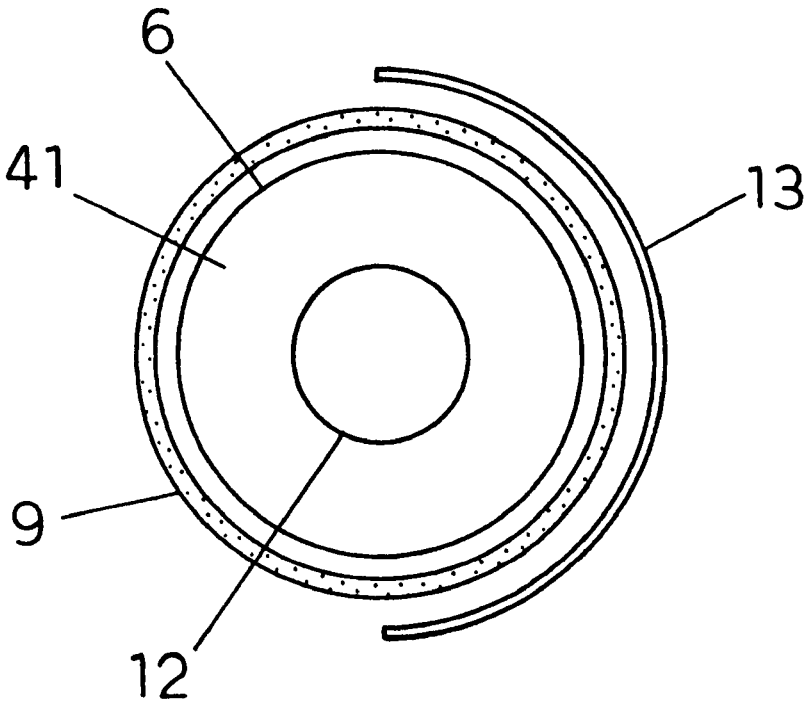

FIG. 8 is a schematic sectional view showing main parts of the sixth embodiment and FIG. 9 is a horizontal sectional view showing the main parts. In FIG. 8, a transmission window 9 composed of a cylindrical heat-resistant glass plate is disposed around a metal catalyst body 12 which is vertically disposed upstream a catalyst body 6 and a reflecting plate 13 is disposed in opposition to the transmission window 9 so as to cover about half a circumference thereof. As a result of a combustion reaction which takes place on an upstream surface of the catalyst body 6, this surface is incandescent and radiates heat rays to a downward area including surroundings and the heat rays are partially dissipated also to an outer circumference of a combustion chamber 41 by way of the transmission window 9. The radioactive heat dissipated outside is reflected by the reflecting plate 13, returned again into the combustion chamber 41 and is used for heating the metal catalyst body 12. Accordingly, the metal catalyst body 12 is heated, incandesces with higher luminance and emits intense radiation to a side on which the reflecting plate 13 is not disposed. The sixth embodiment is capable of supplying a large amount of radioactive heat at a low fuel consumption rate when it is used as a combustor having a directional property, and can be used effectively as an illuminator which radiates rays having short wavelengths. In addition, the sixth embodiment is capable of maintaining a temperature sufficient to continue a reaction and cause stable combustion with high incandescence by recovering heat by way of the reflecting plate 13 even when a sparingly combustible fuel (for example, methane) which cannot maintain stable combustion with heat conducted and radiated directly from the catalyst body 6, and combustion heat on the catalyst body 12 itself.

It is not always necessary to configure the transmission window 9 so as to have the cylindrical form as in the sixth embodiment and it is possible to configure it as a prism which has a plurality of planar transmission windows 9 distributed in a circumferential direction. Further, it is possible to compose the combustion chamber 41 partially of metal walls and dispose the transmission windows 9 only in required directions. It is also possible to configure the reflecting plate 13 so as to have an optional shape such as an elliptic shape, a polygonal shape or planar shape, dispose it at a location apart from the transmission window 9 as in the sixth embodiment or in close contact with the transmission window 9 and bring a thin film of metal such as tin oxide into close contact with the heat-resistant glass material composing the transmission window 9 by means such as deposition for allowing the sixth embodiment to exhibit the effect described above.

(Seventh Embodiment)

A seventh embodiment of the present invention will be described. The seventh embodiment is similar in its fundamental configuration to the first embodiment, but is different in that an auxiliary catalyst body is disposed in a combustion chamber 41. Description will be made mainly of this difference.

FIG. 10 is a sectional view illustrating the configuration of the seventh embodiment. In FIG. 10, an auxiliary catalyst body 14 which is composed of a noble metal of the platinum group carried on a mesh made of a metal of the iron-chromium-aluminium series and has an inclined shape is disposed between a catalyst body 6 and a transmission window 9 in the vicinity of an injection port 5 which is open in a premixing chamber 4. A fuel (butane gas in the seventh embodiment) which is fed from a fuel tank 1 is exhausted at a high pressure under a flow rate control by a control valve 2, mixed in a mixer 3 equipped inside with a nozzle and a slot (not shown) while sucking ambient air with a flow of a gas injected from the nozzle and supplied into a premixing chamber 4 through the injection port 5 for causing catalytic combustion in the vicinity of an upstream surface (a surface opposed to a transmission window 9) of the catalyst body 6. Combustion waste gas is exhausted from a downstream exhaust gas flow path 8 by way of communicating slots of the catalyst body 6. Out of a large amount of heat rays radiated from the upstream surface of the catalyst body 6 which is heated in an incandescent condition by combustion heat, components having short wavelengths which are mainly consist of visible rays are exhausted forward after transmitting directly through a coat layer 10 and the transmission window 9, whereas heat rays are partially absorbed by the transmission widow 9 and then exhausted as a secondary radiation from the transmission window 9.

Almost all components which have long wavelengths are reflected by the coat layer 10, returned to a side of the catalyst body 6, further enhance a temperature of the catalyst body 6 and function to emit a larger amount of radioactive heat rays rich in the components having the short wavelengths. Accordingly, most visible rays and a portion of heat rays having long wavelengths are emitted from the transmission window 9 formed in a front surface of the premixing chamber 4 and used for illumination or other purposes. When an amount of the fuel injected into the mixer 3 is reduced by manipulating the control valve 2, an amount of air sucked by the mixer 3 is also reduced and an amount of mixed gas supplied from the injection port 5 is reduced (a flow speed is lowered simultaneously), whereby a reaction heat on the catalyst body 6 is reduced and its temperature is lowered. When a flow rate of the fuel into the mixer 3 is lowered to 50% to 30% of that for maximum combustion (set to control a temperature of the upstream surface of the catalyst body 6 to 850 to 900° C.), a surface temperature of the catalyst body 6 is 600° C. or lower, whereby incandescence cannot be confirmed visually, and the catalyst body 6 is set in the so-called standby condition where the transmission window 9 scarcely emits visible rays though a combustion reaction continues. When the auxiliary catalyst body 14 is disposed obliquely in the vicinity of the injection port 5 which is open forward in the horizontal direction, the mixed gas flows along main current lines indicated by solid line arrows (A) within a high combustion rate region where a large amount of the mixed gas flows at a high speed, a catalytic combustion reaction scarcely takes place on the auxiliary catalyst body 14 and it is maintained in a heat retaining condition at a temperature of 300° C. to 500° C. while receiving radioactive heat produced by the catalyst body 6. When an amount of the mixed gas is reduced to a level not exceeding a definite or predetermined value, on the other hand, a flow rate is lowered and affected by the upstream inside the premixing chamber 4, the flow line becomes as indicated by a dashed line arrow (B) and the mixed gas flows in contact with the auxiliary catalyst body 14. Since the auxiliary catalyst body 14 is retained at a temperature at which a catalytic reaction can take place, it starts a burning reaction and is set in an incandescent condition of 700° C. to 800° C. due to a concentrated combustion reaction on the auxiliary catalyst body 14 which has a small thermal capacity. Since the auxiliary catalyst body 14 has a high aperture ratio, all the fuel does not react on the auxiliary catalyst body 14 but is supplied in a sufficient amount to the catalyst body 6 located downstream, thereby securing a temperature at which a reaction activity is maintained (approximately 400° C. or higher) and continuing the standby combustion condition. Visible rays which are emitted from the incandescent auxiliary catalyst body 14 are supplied forward through the transmission window 9, thereby securing a partially incandescent state even in the standby combustion and permitting continuation of combustion. Since all amount of the fuel consumed in this condition is a minimum which is required only for maintaining an active temperature of the catalyst body 6 and the visual confirmation of incandescent condition of the auxiliary catalyst body 14, the seventh embodiment is excellently economical. When the seventh embodiment is used as a portable combustor equipped with the fuel tank 1 in particular, it requires fuel charging and container replacement less frequently, and can be used conveniently. When the fuel feeding rate is enhanced for normal use, the seventh embodiment restores the original incandescent condition in a moment since the catalyst body 6 is always kept in the active condition, and the auxiliary catalyst body 14 is simultaneously set out of the flow lines and returned to a standby condition.

Though the seventh embodiment is described as an example of combustor which utilizes the visible rays, a combustor which does not use the coat layer 10 on the transmission window 9 also exhibits the function and effect described above. Though the auxiliary catalyst body 14 is disposed at a location which is fixed relative to the flow lines of the mixed gas supplied from the injection port 5, the auxiliary catalyst body 14 may be movably disposed by mechanically interlocking it with the control valve 2 or indirectly interlocked (for example, driven with a bimetal) so as to be movable dependently on temperatures detected in the vicinity of the premixing chamber 4 for maintaining the incandescent condition and the standby condition more securely.

(Eighth Embodiment)

Description will be made of an eighth embodiment of the present invention. The eighth embodiment is configured so as to comprise, outside a transmission window 9, a reflecting cover which reflects heat rays and is interlocked with a combustion rate control valve so as to be freely openable and closable, and has functions and effects which are similar to those of the seventh embodiment, but is different in utilization of heat rays in a standby combustion condition. Accordingly, description will be made mainly of the difference.

FIG. 11 is a sectional view illustrating a configuration of the eighth embodiment. In FIG. 11, a reference numeral 15 represents a reflecting cover which is disposed outside a transmission window 9 formed as a front surface of a premixing chamber 4, interlocked with a control valve 2 so as to be freely openable and closable. A peep window 16 is opened in the reflecting cover 15 at a location forward an auxiliary catalyst body 14. The reflecting cover 15 is composed of a stainless steel plate and has an inside surface which is polished into a mirror surface. When a fuel feeding rate into a mixer 3 is lowered by the control valve 2, the reflecting cover 15 which is interlocked with the control valve 2 is moved so as to cover an outside surface of the transmission window 9 in such a condition as shown in FIG. 11. Heat rays emitted from a catalyst body 6 transmit directly trough the transmission window 9 or are supplied forward as a secondary radiation after being absorbed by the transmission window 9. Since the reflecting cover 15 which has the mirror surface having high reflectance is disposed, radioactive heat is scarcely dissipated outside, but reflected, returned again to the catalyst body 6 and used for temperature enhancement. Therefore, the eighth embodiment is capable of maintaining the catalyst body 6 sufficiently in an active temperature condition by supplying a trace amount of fuel and remarkably reducing a fuel consumption rate in the standby combustion condition. On the other hand, visible rays emitted from an auxiliary catalyst body 14 which has started a combustion reaction and is set in an incandescent condition by modifying a flow path for a mixed gas are supplied forward by way of the peep window 16 formed in front of an auxiliary catalyst body 14 and continuation of combustion can be visually confirmed. Since the auxiliary catalyst body 14 and the peep window 16 formed in the reflecting cover 15 are not required when it is unnecessary to visually confirm the continuation of combustion in the combustor, these two members may be disposed and used as occasion demands. Further, it is not always necessary to mechanically interlock the reflecting cover 15 with the control valve 2, but the reflecting cover 15 may be mechanically or electrically operated in conjunction with temperature detection at an adequate location or configured as an independent manual control cover. That is, the reflecting cover 15 may be detachable. Accordingly, the eighth embodiment makes it possible to lower a fuel consumption rate in the standby combustion condition and securely maintain the catalyst body 6 at a sufficient temperature. In addition, such thin films as those described above may be formed on an inside surface, outside surface, etc. of the transmission window 9 shown in FIG. 11.

(Ninth Embodiment)

A ninth embodiment of the present invention will be described below. The ninth embodiment is similar in its fundamental configuration to the eighth embodiment, but is different in configurations of a reflecting cover 15 and an incandescent location for confirming a standby combustion condition. Description will be made mainly of these differences.

FIG. 12 is a sectional view illustrating a configuration of the ninth embodiment. In FIG. 12, a reference numeral 15 represents a reflecting cover which covers a front surface of a transmission window 9 in a standby combustion condition, a concave mirror section 17 which has a focal point on a portion of a catalyst body 6 is disposed inside the reflecting cover 15 and a peep window 16 is formed in a central portion of the concave mirror section 17. In the standby combustion condition where a fuel feeding rate is lowered, the reflecting cover 15 is shifted (mechanically, electrically or manually) so as to cover an outside surface of the transmission window 9 in such a condition as shown in FIG. 12. Heat rays which are radiated from the catalyst body 6 transmit directly through the transmission window 9 or are supplied forward as a secondary radiation from the transmission window 9 after being absorbed by the transmission window 9. Since the concave mirror section 17 is disposed forward transmission window 9, radioactive heat is scarcely dissipated outside, but reflected and returned again to the catalyst body 6. Since the reflected heat rays are concentrated on the central portion of the catalyst body 6 which is located at the focal point of the concave mirror section 17 (indicated by dashed line arrows (C)), only the central portion of the catalyst body 6 is heated, incandesced and set in a condition to radiate visible rays. This incandescent condition can be visually confirmed through the peep window 16 formed in the central portion of the concave mirror section 17 (indicated by a dashed line arrow (D)), whereby continuation of combustion can be confirmed even in standby combustion condition. Since most of heat rays dissipated from the catalyst body 6 are reflected and returned by the concave mirror section 17, a small amount of combustion heat is sufficient to incandescence a portion (i.e., the vicinity of the focal point), and the ninth embodiment makes it possible to save a fuel, maintain the catalyst body 6 in the temperature retained standby condition and visually confirm this condition reasonably and economically. It is not always necessary to locate the focal point of the concave mirror section 17 at the central portion of the catalyst body 6 and the peep window 16 can be formed at an adequate location corresponding to the focal point. Further, the reflecting cover 15 need not necessarily be mechanically interlocked with the control valve 2 as in the eighth embodiment, but may be mechanically or electrically operated in conjunction with temperature detection at an adequate location or configured as an independent manual control cover. That is, the cover 15 may be detachable.

(Tenth Embodiment)

A tenth embodiment of the present invention will be described below. The tenth embodiment is similar in its fundamental configuration to the seventh embodiment, but is different in a configuration of a transmission window. Description will be made mainly of this difference.

FIG. 13 is a sectional view illustrating the configuration of the tenth embodiment. In FIG. 13, a second transmission window 18 is disposed outside a front surface of a transmission window 9 with a gap reserved therebetween, and a coat layer 10 composed of a thin ITO (a composite oxide of indium and tin) which reflects heat rays having long wavelengths is disposed on an inside surface of the second transmission window 18. Further, formed between the transmission window 9 and the second transmission window 18 is an air flow path 19 which is open to atmosphere at its top and communicates with a mixer 3 at its bottom. Whether or not a fuel feeding rate is high or low, a portion of heat rays which are radiated from a catalyst body 6 in a combustion condition transmit through the transmission window 9, whereas the rest portion of the heat rays are absorbed by the transmission window 9 and supplied forward as a secondary radiation. Since the second transmission window 18 having the coat layer 10 which reflects components having long wavelengths is disposed forward the transmission window 9, radioactive components having the long wavelengths (a portion of components having transmitted through the transmission window 9 and most of components supplied as the secondary radiation) are reflected by the coat layer 10, returned first to the transmission window 9 and heat this window though radioactive components having short wavelengths which consist mainly of visible rays are supplied forward. Since heat is dissipated again from the transmission window 9 which is heated, a temperature of the catalyst body 6 is enhanced, thereby making it possible to maintain the catalyst body 6 a high temperature at a low combustion rate and obtain a high temperature radiation (i.e., rich in the visible ray components) with a high efficiency. This function exhibits a higher effect in a low combustion rate condition where most of radiated components have long wavelengths at a low reaction temperature, i.e., a standby combustion condition, and is effective for lowering a fuel cost in the standby combustion condition. On the other hand, the air flow path 19 which is formed outside the transmission window 9 which is at the enhanced temperature functions as a thermal buffer region for the second transmission window 18 which prevents a material composing the coat layer 10 from being thermally deteriorated and serves for maintaining stable performance for a long time. Further, air which passes through the air flow path 19 is heated since it is brought into contact with the transmission window 9 and the second transmission window 18 which are heated due to the absorption of heat rays. By recovering heat from the heated air and introducing the recovered heat into a mixer 3 for use as air for combustion (indicated by a dashed line arrow (E) in FIG. 13), it is effective for maintaining a temperature of the catalyst body 6 and enhancing a combustion temperature, thereby making it possible to further lower a fuel consumption rate. In addition, the recovery of heat accelerates a temperature drop of the second transmission window 18 which is exposed outside, thereby making it possible to avoid dangers such as burning hazard without lowering transmission of the visible rays, and economically maintain safe and stable combustion. Though it is most effective to reuse the atmosphere allowed to flow through the air flow path 19 as the air for combustion as described above, apertures may be formed in top and bottom of the air flow path 19 so as to allow atmosphere to flow naturally their through or flow a premixed gas at a concentration below a combustion limit, thereby making it possible to lower a temperature of the second transmission window 18, obtain effects for prevention of thermal deterioration of the coat layer 8 and maintain security.

Though the embodiments have been described above as examples wherein the combustor according to the present invention is configured as combustors for gas fuels, it is needless to say that the present invention is not limited by these embodiments. That is, the cases which are described below are included within a scope of the present invention.

The present invention is applicable not only to gas fuels such as city gases which are supplied through pipes but also liquid fuels such as kerosine. Air supply means such as a blower fan is added as occasion demands when a gas fuel such as a city gas which is supplied at a low pressure is to be used or means for vaporizing a liquid fuel is added upstream a premixer when a liquid fuel is to be used.

Though the ceramic honeycomb is used as the carrier for the catalyst body, a material and shape of the carrier are not limited so far as a carrier has a large number of communicating slots through which a premixed gas can flow and it is possible to use, for example, a sintered ceramic or metal material, a metal honeycomb, a metallic nonwoven fabric or a braided metallic fiber as a carrier and its form is not limited to a planar form, but may be a curved form, cylindrical form, corrugated form or other optional form which is selected in accordance with workability and a purpose of use of a material. Though a noble metal of the platinum group such as platinum, palladium or rhodium is general as the active component, it may be a mixture of these metals, another metal, an oxide thereof or a substance having a mixture constitution thereof and it is possible to select an active component which is matched with a kind of fuel and conditions of use.

Though the electric heater is used as the igniter means, it is not limitative and any means is usable as the igniter means so far as it raises a temperature of the catalyst body. For example, it is possible, without degrading the effects of the present invention, to dispose a firing device in the vicinity of the injection port for forming a flame first at this location, extinguish the flame by stopping fuel feeding when the catalyst body has a predetermined activity owing to heating with a high temperature exhaust gas and start a catalytic combustion reaction by restarting the fuel feeding immediately after the extinguishment or adopts a method to dispose electric heater means in the vicinity of the catalyst body and raise temperature to a predetermined level by electric heating. However, it is effective for practical use to form a flame downstream the catalyst body and use means which shifts flame combustion automatically to stable catalytic combustion when the combustor is to be used outdoors in particular so that no complicated control, detection, auxiliary part therefor or a large amount of electric input is necessary. In addition, it is effective for obtaining a perfect combustor which is free from a power source to use a piezoelectric igniter as the igniter for starting the flame combustion.

Possibilities of Industrial Utilization

As understood from the foregoing description, the catalytic combustor according to the present invention permits obtaining radioactive rays rich in the visible rays with a high efficiency at a low fuel consumption rate and is usable as an illuminator which suppresses unwanted heat output and features a high energy efficiency since the catalytic combuster transmits radioactive heat rays having short wavelengths and reflects radioactive heat rays having long wavelengths so as to be returned to the catalyst body out of the radioactive heat from an upstream surface of a catalyst body which emits high temperature heat radiation in a large amount. The heat returning function makes it possible to maintain the catalyst body always in a highly active condition for securing complete combustion, prevent incomplete combustion from taking place and obtain a clean waste gas characteristic even when a sparingly combustible fuel or a dilute premixed gas is used.

Further, the catalytic combustor according to the present invention is capable of maintaining a stable complete combustion condition in which the catalyst is not thermally injured or incomplete combustion takes place when it comprises the flow rate control valve which opens and closes dependently on temperature conditions of the catalyst body. The catalytic combustor according to the present invention can be configured as a multi-purpose apparatus which is usable optionally or selectively for heating and illumination, or is a highly convenient combustor when the transmission window is formed in two layers and a thin film which reflects heat rays having long wavelengths is disposed on a side of a movable window.

Furthermore, the catalytic combustor according to the present invention is capable of causing a large amount of combustion reaction in a combustion chamber having a small capacity, obtaining a high radiation efficiency and exhibiting an effective heating function or illuminating function by incandescing the metal catalyst body which is disposed in opposition to the transmission window, and has a high aperture ratio and a small thermal capacity. The catalytic combustor according to the present invention is capable of feeding back radioactive heat in accordance with reactivities of fuels and causing complete combustion with a high radiative efficiency even when it uses a sparingly combustible fuel such as methane.

Moreover, the catalytic combustor according to the present invention can be configured as a combustor which is economical, has high operability and permits visual confirmation of continuation of combustion while maintaining a minimum reaction temperature in a standby combustion condition when it comprises the auxiliary catalyst body which has a high aperture ratio and a small volume, and is disposed at a location brought into contact with the flow lines when an amount of a mixed gas is smaller than a definite value. The catalytic combustor according to the present invention is configured as a combustor which is capable of remarkably reducing a fuel consumption rate in the standby combustion condition, expanding a variation control range so as to permit confirming the continuation of combustion as occasion demands, and can be controlled momentarily and very easily at an optional timing when it comprises a freely openable/closable cover which is disposed in the vicinity of the outside surface of the transmission window and has reflectivity to heat rays. In addition, the catalytic combustor according to the present invention is configured as a highly economical, convenient and safe combustor which lowers temperature on a sheath while effectively utilizing combustion heat and maintains stable combustion in the standby combustion condition when it comprises the air flow path which is formed between the transmission window and a second transmission window, and a thin film coat which is disposed on an inside surface of the second transmission window for reflecting radioactive heat rays having long wavelengths.

What is claimed is:

1. A catalytic combustor characterized in that it comprises:

a catalyst body which has a large number of communicating slots;

a premixed gas chamber which covers an upstream surface of said catalyst body, and constitutes a space for introducing therein a premixed gas of a fuel and air; and a transmission window which is disposed at a location of said premixed gas chamber opposed to said catalyst body and made of a heat ray transmissive material, wherein a surface of said transmission window is coated with a thin film of a metal or a metal oxide which transmits visible rays and reflects infrared rays.

2. A catalytic combustor according to claim 1 characterized in that the thin film coat of said transmission window is disposed on a surface opposed to said catalyst body.

3. A catalytic combustor according to claim 1 characterized in that the thin film coat of said transmission window includes a wavelength converting material.

4. A catalytic combustor according to claim 1 or 2 characterized in that said transmission window is formed in two layers, that said thin film coat is disposed only on a surface of an outer transmission window, and that this outer transmission window is disposed so as to be freely attachable and detachable.

5. A catalytic combustor characterized in that it comprises:

a catalyst body which has a large number of communicating slots;

a premixed gas chamber which covers an upstream surface of said catalyst body, and constitutes a space for introducing therein a premixed gas of a fuel and air; and a transmission window which is disposed at a location of said premixed gas chamber opposed to said catalyst body and made of a heat ray transmissive material, wherein a flow rate control valve made of a heat-sensitive deformable metal is disposed in a premixed gas introducing port of said premixed gas chamber and an aperture of a flow path is controlled in correspondence to a surface temperature of said catalyst body.

6. A catalytic combustor characterized in that it comprises:

a combustion chamber which has an injection port for a mixed gas of a fuel and air at an upstream end, a gas exhaust port at a downstream end; and said combustion chamber having a transmission window which is formed at least in a portion of a side wall and is made of a heat ray transmissive material;

a catalyst body which is disposed in the vicinity of a downstream end of said combustion chamber and has a large number of communicating slots; and a metal catalyst body which is disposed nearly in parallel with said transmission window so as to locate one end in the vicinity of said catalyst body between said mixed gas injection port and said catalyst body, and composed of an oxidative catalyst component carried on a metal wire structure having a large aperture ratio.

7. A catalytic combustor according to claim 6 characterized in that said metal catalyst body is composed of multiple cylindrical or planar layers which have different lengths in a flow direction of a premixed gas, and are disposed so as to reserve gaps from one another and not to align their tips.

8. A catalytic combustor according to claim 6 characterized in that said metal catalyst body has a conical or pyramidal form which has a tip on an upstream side and a bottom in the vicinity of said catalyst body disposed on the downstream side.

9. A catalytic combustor according to claim 6, 7 or 8 characterized in that said transmission window is disposed along almost all circumference of said combustion chamber and a heat ray reflecting body is disposed in the vicinity of at least a portion of an outside surface of said transmission window.

10. A catalytic combustor characterized in that it comprises:

a flow rate controller which adjusts a flow rate of a mixed gas of a fuel and air;

a combustion chamber which has a mixed gas injection port communicated with said flow rate controller on an upstream side and an exhaust gas outlet port on a downstream side;

a catalyst body which is disposed in said combustion chamber and has a large number of communicating slots;

a transmission window which is disposed on a wall of said combustion chamber opposed to an upstream side surface of said catalyst body and made of a heat ray transmissive material; and an auxiliary catalyst body which has a high aperture ratio and a small capacity, and is disposed in the vicinity of said injection port between said catalyst body and said transmission window, wherein when the amount of mixed gas from the injection port is less than a predetermined value, the mixed gas contacts the auxiliary catalyst body.

11. A catalytic combustor characterized in that it comprises:

a flow rate controller which adjusts a flow rate of a mixed gas of fuel and air;

a combustion chamber which has a mixed gas injection port communicating with said flow rate controller on an upstream side and an exhaust gas outlet port on a downstream side;

a catalyst body which is disposed in said combustion chamber and has a large number of communicating slots;

a transmission window which is disposed on a wall of said combustion chamber opposed to an upstream side surface of said catalyst body and made of a heat ray transmissive material; and a movable cover, said cover moved to cover an outside surface of said transmission window when an amount of the flow rate of mixed gas is less than a predetermined value.

12. A catalytic combustor according to claim 10 including a movable cover, said cover moved to cover an outside surface of said transmission window when an amount of the flow rate of mixed gas is less than a predetermined value, and an aperture formed in said cover for viewing said auxiliary catalyst body.

13. A catalytic combustor according to claim 11 characterized in that said cover includes a concave mirror having a focal point on said catalyst body and an aperture at a central portion of said concave mirror.

14. A catalytic combustor according to claim 10 or 11 including a thin film coat of a metal or a metal oxide for transmitting components having short wavelengths and reflecting components having long wavelengths, said film coat disposed on an inside surface of said transmission window.

15. A catalytic combustor according to claim 14 characterized in that said transmission window is formed, as an outer window and an inner window, wherein said thin film coat is disposed on an inside surface of said outer window, and a flow path is formed between said inner and outer windows for allowing circulation of ambient atmosphere.

16. A catalytic combustor according to claim 15 characterized in that said atmosphere flow path formed between said inner and outer windows is connected to an air feeding path communicating with said flow rate controller.

* * * * *

UNITED STATES PATENT AND TRADEMARK OFFICE

CERTIFICATE OF CORRECTION

PATENT NO. : 5,975,890
DATED : November 2, 1999
INVENTOR(S) : Kawasaki et al.

It is certified that error appears in the above-identified patent and that said Letters Patent is hereby corrected as shown below:

Title page,
Item [56], References Cited, list the following:

-- FOREIGN PATENT DOCUMENTS

| | | |
|---|---|---|
| 04353306 | 12/1992 | Japan |
| WO 9513501 | 5/1995 | WIPO |

OTHER DOCUMENTS

European Search Report, dated June 22, 1999, appn. No. EP97-92-7373. --

Signed and Sealed this

Second Day of July, 2002

*Attest:*

*Attesting Officer*

JAMES E. ROGAN
*Director of the United States Patent and Trademark Office*